US008770452B1

(12) United States Patent
Gottlieb

(10) Patent No.: US 8,770,452 B1
(45) Date of Patent: Jul. 8, 2014

(54) EXPANDABLE CLOTHES HANGER

(71) Applicant: Steven T. Gottlieb, Potomac, MD (US)

(72) Inventor: Steven T. Gottlieb, Potomac, MD (US)

( * ) Notice: Subject to any disclaimer, the term of this patent is extended or adjusted under 35 U.S.C. 154(b) by 0 days.

(21) Appl. No.: 13/775,977

(22) Filed: Feb. 25, 2013

Related U.S. Application Data

(63) Continuation-in-part of application No. 13/407,347, filed on Feb. 28, 2012, now abandoned, which is a continuation-in-part of application No. 13/246,927, filed on Sep. 28, 2011, now abandoned.

(51) Int. Cl.
*A41D 27/22* (2006.01)

(52) U.S. Cl.
USPC ..... 223/92; 223/68; 223/85; 223/94

(58) Field of Classification Search
USPC ..... 223/68, 69, 85, 88, 89, 92, 94
See application file for complete search history.

(56) References Cited

U.S. PATENT DOCUMENTS

| | | | | |
|---|---|---|---|---|
| 1,102,545 | A * | 7/1914 | Prouty | 223/96 |
| 1,744,050 | A | 1/1930 | Lopin | |
| 1,915,556 | A | 6/1933 | Stevens | |
| 2,160,325 | A | 5/1939 | Brooke | |
| 2,209,468 | A | 7/1940 | Nathan | |
| 2,212,524 | A * | 8/1940 | Huff | 223/96 |
| 2,639,844 | A | 5/1953 | Udvardy | |
| 2,796,206 | A | 6/1957 | Schwartz | |
| 2,924,362 | A * | 2/1960 | Brooke | 223/91 |
| 2,929,538 | A | 3/1960 | Douglas | |
| 2,998,903 | A | 9/1961 | Day | |
| 4,917,278 | A | 4/1990 | Ventimiglia | |
| 4,988,021 | A | 1/1991 | Adams et al. | |
| 5,826,759 | A * | 10/1998 | Ohsugi | 223/85 |
| 7,097,081 | B2 | 8/2006 | Frassinelli | |
| 7,172,102 | B2 | 2/2007 | Lewien et al. | |
| 7,182,232 | B2 | 2/2007 | Fleming et al. | |
| 7,246,729 | B2 | 7/2007 | Harvey et al. | |
| 7,249,699 | B2 | 7/2007 | Hill et al. | |
| 7,455,202 | B2 | 11/2008 | Shimura | |
| 7,644,844 | B1 | 1/2010 | Bonner | |
| 7,743,954 | B2 | 6/2010 | Chiu | |
| 7,784,654 | B1 | 8/2010 | Mercado | |
| 7,828,179 | B2 | 11/2010 | Sprovieri | |
| 8,028,869 | B2 | 10/2011 | Rossaki | |

FOREIGN PATENT DOCUMENTS

| | | | | |
|---|---|---|---|---|
| GB | 2129676 A | | 5/1984 | |
| GB | 2129676 A | * | 5/1984 | A47J 51/08 |

* cited by examiner

*Primary Examiner* — Nathan Durham
(74) *Attorney, Agent, or Firm* — Blank Rome LLP

(57) ABSTRACT

An expandable clothes hanger to hang, display, store, or transport an article of clothing with minimal creasing. The expandable clothes hanger has a hook extending upward from a bar element that supports an upper portion of an article of clothing draped thereon. Downward extending elements extend downward from the bar element and cross each other at at least a single point. Raising the crossing point along the downward extending elements causes the lower portion of the downward extending elements to extend outward, pulling taut the lower portion of draped article of clothing. Lowering the crossing point along the downward extending elements causes the lower portion of the downward extending elements to be pulled together, allowing for more compact storage of the expandable clothes hanger or for easier placement or removal of draped articles of clothing. The downward extending elements can also be configured as an attachment to a conventional hanger.

17 Claims, 6 Drawing Sheets

EXPANDABLE CLOTHES HANGER

RELATED APPLICATIONS

The present application is a continuation-in-part of Ser. No. 13/246,927, filed Sep. 28, 2011, and Ser. No. 13/407,347, filed Feb. 28, 2012, the contents of which are hereby incorporated by reference.

BACKGROUND OF THE INVENTION

1. Field of the Invention

The present invention relates to a clothes hanger configured for hanging, display, storage, and/or transport of clothing which reduces creasing. More specifically, embodiments relate to an expandable hanger that expands or widens to help prevent creasing in clothing.

2. Background of the Related Art

Conventional clothes hangers are typically formed of a wire, wood, or plastic piece and include a hook portion with two opposing arms that are used for hanging the clothes. Conventional hangers of this nature support only the top portion of the draped apparel while allowing the remaining portion of the apparel to hang freely. As a result of the lower portion being unsupported, the lower portion of the draped apparel is prone to becoming folded, creased, wrinkled, crumpled, or otherwise disordered, particularly during transport or when placed in close proximity to similarly-supported apparel on other hangers. This can occur in a number of situations, including when the hangers and their associated apparel are hung in closets; when the hangers and their associated apparel are hung on display in stores; or when the hangers and their associated apparel are hung, stored, or transported by dry cleaning businesses or their customers.

SUMMARY OF THE INVENTION

In an embodiment, a clothes hanger is provided which incorporates a lower portion of the hanger to pull outward and tautly the lower portion of the draped apparel. As a result, an embodiment is an improved hanger for clothing to reduce or eliminate the negative effects of folding, creasing, wrinkling, crumpling, or other distress on clothing due to use of conventional hangers.

In an embodiment, an expandable clothes hanger comprises a bar element upon which an article of clothing can be draped, a hook extending upward from the bar element, and two downward extending elements, extending downward from the bar element. In an embodiment, the downward extending elements come together in a first position, and can be pushed or pulled apart to a second position, wherein the two downward extending elements move to a position to make taut a lower portion of the draped article of clothing. In an embodiment, the downward extending elements are configured as an attachment that can be attached to a conventional clothes hanger. In an embodiment, attachment or the hanger itself can be doubled up to provide support for both the upper and lower portions of a draped article of clothing. In an embodiment, a support bar can be added from the shoulder portion to the lower portion of a draped article of clothing to provide support along the sides of a draped article of clothing. In an embodiment, expandable clothes hanger includes a second set of downward extending elements that can be used to protect an upper portion of the draped article of clothing.

Additional features and embodiments of the present invention will be evident in view of the following detailed description of the invention.

BRIEF DESCRIPTION OF THE DRAWINGS

FIG. 15(*a*) is an exploded view of FIG. 15.

FIG. 15(*b*) shows the attachment of FIG. 15 in an expanded position.

FIG. 16(*a*) shows the attachment of FIG. 16 in an expanded position.

DETAILED DESCRIPTION OF THE PREFERRED EMBODIMENTS

Figure 1:
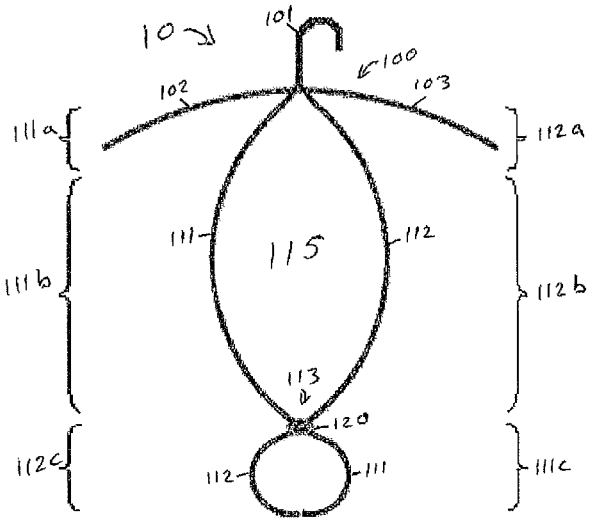
FIG. 1 is an illustration of an expandable clothes hanger in a retracted rest position according to an embodiment of the present invention.

FIG. 1 is an illustration of an expandable clothes hanger 10 in a retracted position according to an embodiment of the present invention. In the embodiment shown, the expandable clothes hanger 10 comprises an optional hook 101 and cross-section arms or bar element 100 which extend outward from the hook 101. The hook 101 can be used, for example, to hang the expandable clothes hanger 10 on a bar or other hanger support structure. The hook 101 extends upward from a bar element 100. Bar element 100 supports a top portion of a draped article of clothing. Articles of clothing can include any garment including (without limitation but instead for illustrative purposes), for example, shirts, coats, skirts, dresses, and other articles of clothing, whether having collars or not.

In an embodiment, the bar element 100 is substantially horizontal when in use with the hook 101 engaged with a bar. However, the bar element 100 can be angled slightly downward in opposite directions 102, 103 to better accommodate the draped article of clothing. The hook 101 is positioned at approximately the center of the bar element 100. Optionally, the extreme tips 104 of the bar element 100 can be curved to prevent damage to the draped article of clothing. The curvature can be, for instance, downward.

Downward extending elements 111, 112 extend downward from the bar element 100. As shown in the embodiment of FIG. 1, the downward extending elements 111, 112 are symmetrical mirror images of one another. In an embodiment, downward extending elements 111, 112 are curved to substantially form the shape of an oval or ellipse 115 with a central longitudinal axis extending downward approximately perpendicular to the outward extending bar element 100.

Figure 6:
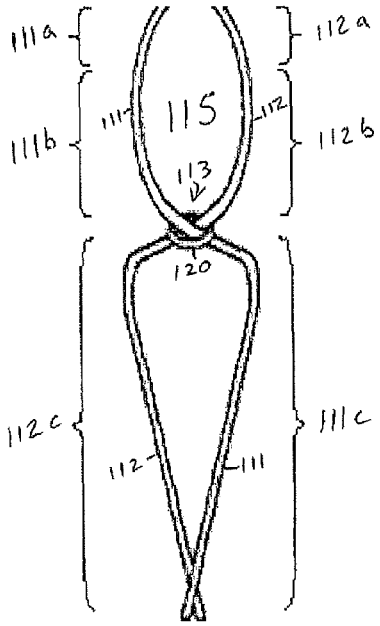
FIGS. 6, 7 show a front view of a clothes hanger in accordance with another embodiment of the invention with the downward elements longer below the intersection point and bent outwardly.
Figure 7:
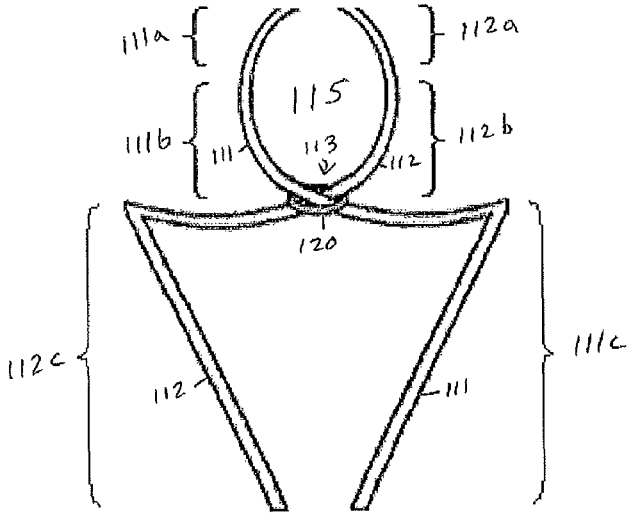
Figure 8:
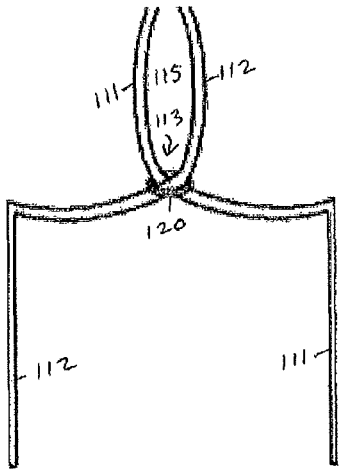
FIG. 8 is a front view of the hanger of FIG. 7 with the downward elements in an expanded position.

Each of the downward elements 111, 112 have a proximal top portion 111*a*, 112*a*, a middle portion 111*b*, 112*b*, and a distal bottom portion 111*c*, 112*c*. The top portions 111*a*, 112*a* are positioned relatively close together at the very ends where they connect or engage with the outward bar element 100. The downward elements 111, 112 then curve outward as they extend downward from the bar element 100. The middle portions 111*b*, 112*b* of the downward elements 111, 112 continue outward, then curve back inward, when continuing to follow the downward elements 111, 112 downward. The middle portions 111*b*, 112*b* continue to curve inward and cross one another at an intersection 113. Past the intersection 113, the distal ends 111*c*, 112*c* flair outward and downward, though other suitable configurations can be provided within the spirit and scope of the invention. It should be noted that the length of the longitudinal axis of the ellipse can vary. For example, intersection 113 may be higher up on downward elements 111, 112 so as to make the upper and middle portions 111*a, b*, 112*a, b* substantially shorter than distal portion 111*c*, 112*c*, as shown in FIGS. 6, 7. One benefit of this configuration may be additional support by the lower portion of downward elements 111, 112 along the length of the draped article of clothing when the hanger is in the expanded position, as shown in FIG. 8.

The curved downward extending elements 111, 112 are configured to intersect at at least one point, intersection 113, along their length. Accordingly, when intersection 113 is moved along downward elements 111, 112 toward distal portion 111*c*, 112*c*, the upper and middle portions 111*a, b*, 112*a, b* move outward with respect to each other, expanding the area of ellipse 115, and the distal portions 111*c*, 112*c* retract inward toward each other. (See FIG. 1.) And, when intersection 113 is moved along downward elements 111, 112 away from distal portion 111*c*, 112*c*, the upper and middle portions 111*a, b*, 112*a, b* move inward toward each other, contracting the area of ellipse 115, and the distal portions 111*c*, 112*c* expand outward away from each other. (See FIG. 2.) In an embodiment, the extreme tips of 111*c*, 112*c* are curved to prevent sharp points that can damage the draped article of clothing. The curvature can be upward or downward and can be inward or outward. Further, the curvature can continue until the ends meet, as shown in FIG. 1, or can stop before they meet. In the embodiment shown, the ends meet so that the bottom portions 111*c*, 112*c* form a lower loop that is substantially smaller than the upper loop formed by the middle portions 111*b*, 112*b*.

Figure 3:
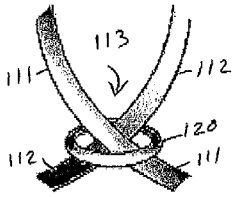
FIG. 3 is an illustration of a moveable clasp binding downward extending elements according to an embodiment of the present invention.

As further shown in FIG. 1, the downward extending elements 111, 112 can be bound together with a mechanism such as a moveable ring 120. FIG. 3 illustrates the moveable ring 120 coupling the downward extending elements 111, 112 together according to an embodiment of the present invention. The moveable ring 120 is shown located at or near the intersection 113 of the downward extending elements 111, 112. The downward extending elements 111, 112 are shown extending through the center of the ring, where they also cross one another. Of course, the ring 120 can be any suitable shape or configuration. However, as shown in FIG. 3, the downward elements 111, 112 are wider than the ring 120 both above and below the intersection 113. Thus, the moveable ring 120 will slide along the length of the downward extending elements 111, 112 in tandem with the intersection 113.

Figure 2:
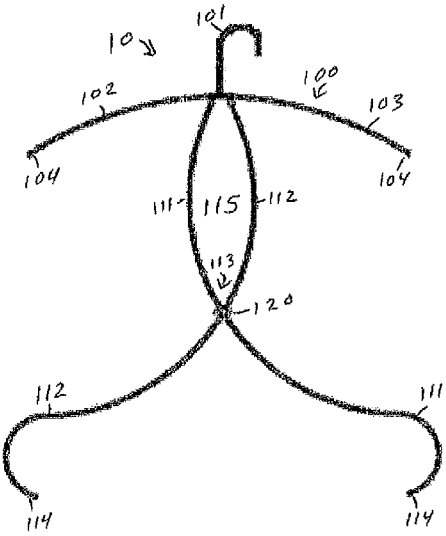
FIG. 2 is an illustration of an expandable clothes hanger in an expanded set position according to an embodiment of the present invention.
Figure 4:
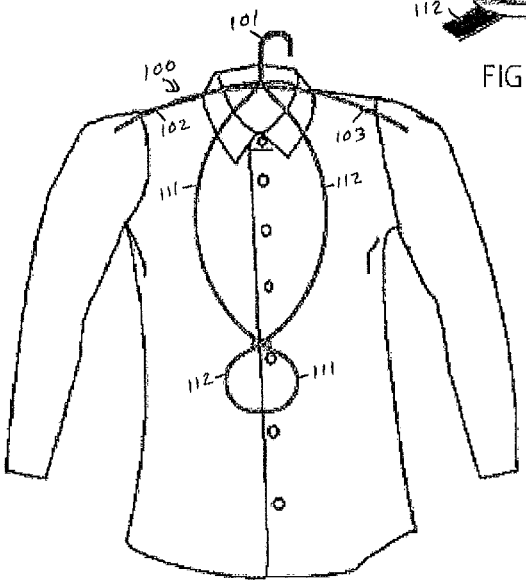
FIG. 4 is an illustration of a shirt hung over an expandable clothes hanger in its retracted rest position according to an embodiment of the present invention.
Figure 5:
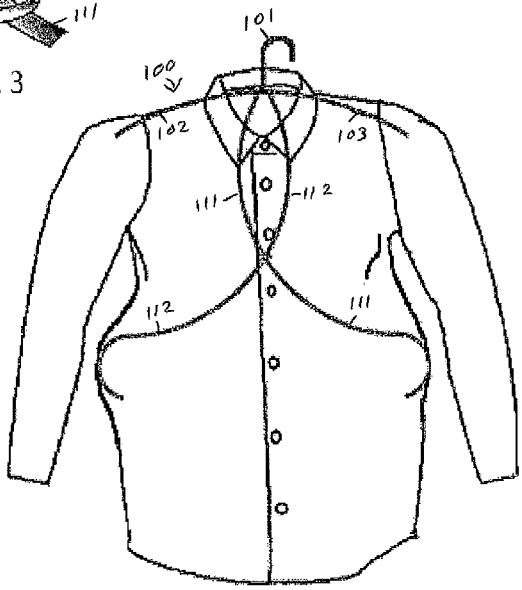
FIG. 5 is an illustration of a shirt pulled taut over an expandable clothes hanger in its expanded set position according to an embodiment of the present invention.

Hanger 10 is configured so that the downward elements 111, 112 move between one of two positions: a contracted or rest position (FIGS. 1, 4) and an expanded or set position (FIGS. 2, 5). Turning first to FIG. 1, the hanger 10 is shown here with the downward elements 111, 112 in the rest position. In this rest position, the intersection 113 is brought closer to the distal portions 111*c*, 112*c* of the downward elements 111, 112 so that the distal portions 111*c*, 112*c* of downward elements 111, 112 are contracted together. The intersection 113 naturally comes to rest at a point on the downward elements 111, 112 where neither downward element 111 nor 112 is pulling inward or pushing outward where the downward elements 111, 112 no longer exert an inward or outward bias.

The rest position allows for more compact packaging, storage, or transport of the hanger, since the distal ends 111*c*, 112*c* of the downward elements 111, 112 are retracted and closer together as compared with the set position of FIG. 2. Placing the expandable hanger in the rest position also enables the user to more easily drape a selected article of clothing over the hanger 10, as shown in FIG. 4, and to more easily remove an article of clothing from the hanger 10.

If the article of clothing has any fastening elements, at least some of those fastening elements are preferably fastened in order to prepare the clothing article to be pulled taut. For instance, the article of clothing is prepared by fastening selected buttons or snaps, tying laces, closing zippers, or utilizing other complementary fastening elements or adornments that may be available on the article of clothing.

Once the article of clothing is prepared to be pulled taut, the intersection 113 is moved along the downward elements 111, 112 away from the distal portions 111*c*, 112*c* and toward the upper proximal portions 111*a*, 112*a*. Moving the intersection 113 in this way causes the upper and middle portions 111*a, b*, 112*a, b* to move inward toward each other, causes the area of the ellipse or upper loop 115 to contract, and causes the distal portions 111*c*, 112*c* to expand outward away from each other. (See FIG. 2.) This outward movement pulls taut the lower portion of the article of clothing. Pulling the lower portion of the article of clothing taut in this manner reduces folding, creasing, wrinkling, crumpling, or other distress otherwise caused by loose fabric. It also provides support to the garment so that a person can work on the garment, such as to perform sewing. For example, FIG. 5 illustrates a shirt pulled taut over an expandable clothes hanger 10 in its set position according to an embodiment of the present invention. The downward elements 111, 112 are configured to pull the clothing taut without unduly stressing the clothing. Thus, the outward tension on the article of clothing supplied by a lower distal portion 111*c*, 112*c* of the downward extending elements 111, 112 is intended to be strong enough to pull the article of clothing taut, but not so strong as to tear or otherwise harm the article of clothing. A variable pressure can be created by using wire, plastic, rubber, or similar flexible material in the manufacture of embodiments of the present invention. The tension can be further adjusted by moving intersection 113 along downward elements 111, 112 away from or toward distal portions 111*c*, 112*c* as desired.

In this set position, the extreme tips 114 of distal portion 111*c*, 112*c* of the downward elements 111, 112 define a distance which is about the same as the distance between the distal ends 104 of the bar element 100. Thus, the extreme tips 114 of distal portion 111*c*, 112*c* of the downward elements 111, 112 are substantially aligned with the extreme tips 104 of the bar element 100. Depending on the size of the clothing received by the hanger 10, the tips 114 of distal portion 111*c*, 112*c* of the downward elements 111, 112 can either be aligned with (e.g., for a straight fit sizing), be shorter than (e.g., for an athletic fit size) or be longer than (e.g., for a larger fit) the distal tips 104 of the bar element.

It should be apparent that moving intersection 113 along downward elements 111, 112 (and, thus, entering the rest and set positions) can be accomplished in several ways. For example, sliding ring 120 along the length of downward elements 111, 112 will correspondingly move intersection 113 since, as noted, the downward elements are wider than the ring 120 both above and below the intersection 113. Sliding ring 120 can be done directly by manually grasping and moving the ring, or indirectly by pushing or pulling ring 120 with a bar, tape, belt, plastic, cloth, rope, thin metal, or other suitable material.

Alternatively, intersection 113 can be moved along downward elements 111, 112 by expanding or contracting ellipse 115 (which will indirectly move ring 120, if used). Bringing together the upper and middle portions 111*a, b*, 112*a, b* of downward elements 111, 112 will contract ellipse 115 and, thus, slide intersection 113 away from distal portion 111*c*, 112*c*. (See FIG. 2.) Moving apart the upper and middle portions 111*a, b*, 112*a, b* of downward elements 111, 112 will expand ellipse 115 and, thus, slide intersection 113 toward distal portion 111*c*, 112*c*. (See FIG. 1.) Expanding and contracting ellipse 115 can be done directly by manually pushing apart or pulling together the upper and middle portions 111*a, b*, 112*a, b* of downward elements 111, 112. Or, expanding and contracting ellipse 115 can be done indirectly. Such indirect method may include using a sliding ring or clamp along the upper and middle portions 111*a, b*, 112*a, b* of downward elements 111, 112 in the same way that clasp 120 slides along downward elements 111, 112 and expands or contracts ellipse 115 from the other end of ellipse 115. Alternatively, a band can be wrapped around the longitudinal center of ellipse 115 and tightened like a belt. The band can be made of plastic, rubber, elastic, tape, cloth, rope, thin metal, or other suitable material. Of course, these are just examples and other methods of indirectly expanding ellipse 115 can be used.

The expandable hanger can be locked in the set position by any means, such as by use of a hook, friction, magnetic force, Velcro, binding, or other locking technique, or by use of a locking clip which physically couples a sliding clamp, the ring 120, or any other part to at least one of the downward elements 111, 112.

When the user wishes to free the article of clothing from the expanded hanger, intersection 113 is brought closer to the distal portion 111*c*, 112*c* of the downward elements 111, 112 so that the distal portion 111*c*, 112*c* of downward elements 111, 112 are contracted together. Of course, if the user has utilized a locking feature in the set position, the lock must first be released. In addition, downward extending elements 111, 112 can be configured with a natural inward bias, so that releasing a lock in the set position causes distal portion 111*c*, 112*c* of downward elements 111, 112 to naturally contract together, returning the hanger to a rest position (FIGS. 1, 4). It should be noted, however, that the natural bias can instead be made to expand distal portion 111*c*, 112*c* of downward elements 111, 112 so that the "rest" position refers to the expanded state of the hanger, and the "set" position refers to the position at which the distal portion 111*c*, 112*c* of downward elements 111, 112 are contracted and ready for the garment to be taken on/off. Thus, the reference to a set or rest position can refer to either the expanded or retracted positions, and is without limitation to the bias of the downward elements 111, 112.

Another embodiment of the invention is shown in FIGS. 6-8. Here, the distal portions 111*c*, 112*c* of the downward extending elements 111, 112 have an added curve or bend that lead into a straight section, which make the distal portions 111*c*, 112*c* larger. By adding a curve or bend to the distal portion 111*c*, 112*c* of the downward extending elements 111, 112 as shown in FIGS. 6, 7, additional support can be provided by downward extending elements 111, 112 along the sides of the article of clothing when the hanger is in the expanded position, as shown in FIG. 8. In the retracted position of FIG. 6, the downward elements 111, 112 cross over each other at the intersecting point 113 (adjacent to ring 120, if it is used) and may also cross over each other at the very bottom of the downward extending elements 111, 112. In the expanded position (FIG. 8), the middle portion of the downward elements 111, 112 extend outward substantially horizontally, and the bottom portion of the downward elements 111, 112 extend substantially vertically downward, with the middle portions being substantially orthogonal to the bottom portions.

It is further noted that the bar 100 and the downward elements 111, 112 (in both the retracted and expanded positions) are within the same plane. Accordingly, the entire hanger 10 (including the hook 101) is planar and lies flat. Thus, the downward elements 111, 112 do not interfere with the placement and removal of the garment on the hanger 10.

In a further embodiment of the invention, the expandable hanger 10 has one or more additional sets of downward extending elements with or without an additional moveable ring. Each additional set of downward expandable elements is configured to provide support to an upper portion or middle portion of an article of clothing supported by the expandable clothes hanger 10. For example, one additional set of downward expandable elements may provide support to a chest portion of a shirt hanging on expandable clothes hanger 10.

Figure 9:
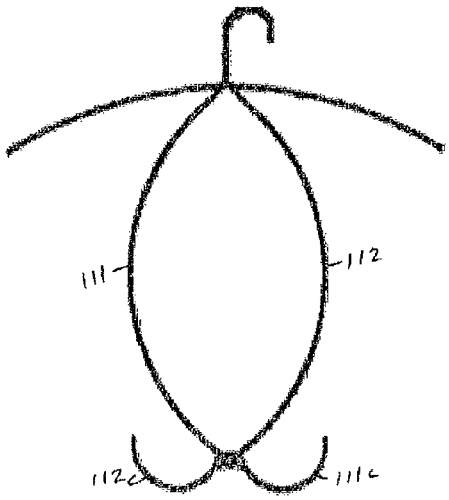
FIG. 9 shows a configuration of the downward elements in accordance with an alternative embodiment of the invention.

It should be apparent that other suitable embodiments, shapes and sizes, of the downward elements 111, 112 can be provided, such as shown in FIG. 9 where the distal portion 111*c*, 112*c* of downward elements 111, 112 have reverse upward bends. Still further, the upper portions 111*a*, 112*a* can cross over so that the proximal ends connect to the bar element 100 at a distance apart from each other to have further stability and support.

Figure 10:
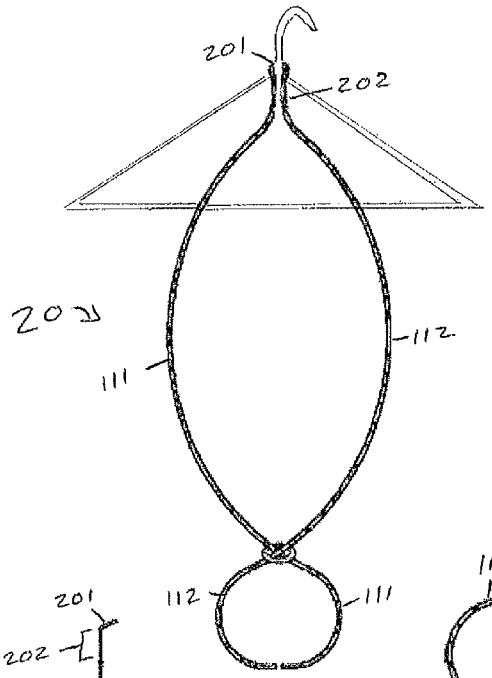
FIG. 10 is an illustration of an expandable clothes hanger formed using an attachment attached to a conventional clothes hanger.
Figure 11:
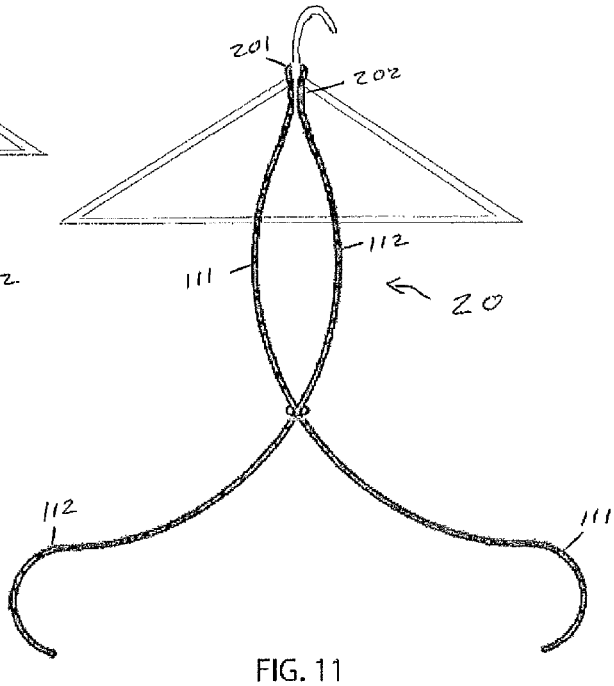
FIG. 11 is an illustration of the attachment in FIG. 10 in an expanded position.

FIG. 10 illustrates an embodiment of the invention in which the downward extending elements 111, 112 (and moveable ring 120, if used) are configured as a separate attachment 20 that can be attached to a conventional clothes hanger to thereby form an expandable clothes hanger. Thus, except for the bar element and the upward hook (see, e.g., 100 and 101, respectively, of FIG. 1), and the protruding bend 201, the elements 111, 112 of the separate attachment 20 are substantially the same as the full expanding hanger 10.

As shown in FIG. 10, there is a protruding bend 201 provided at the top of the attachment 20 to be draped around the upward hook of a conventional hanger. The bend 201 can be U-shaped, V-shaped, square, or any other shape, and can be narrow or wide, as long as it allows for the upward hook of a conventional hanger to pass through. The bend 201 extends upward from the point at which the two arm elements 111, 112 come together at the top portion 111*a*, 112*a* of the attachment 20. That is, just as the arm elements 111, 112 come together, they extend upward and substantially parallel to one another to form a neck 202 with a head that forms the bend 201 where the elements 111, 112 join together. Thus, the elements 111, 112 have a head formed by the bend 201, a neck 202, and the downward extending arms 111, 112.

Figure 12:
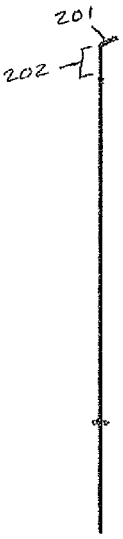
FIG. 12 is a side view of the attachment in FIG. 10, showing the backward-angled bend that would drape over a conventional hanger.
Figure 13:
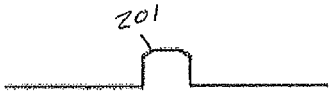
FIG. 13 is a top view of the attachment in FIG. 10, showing the backward-angled bend that would drape over a conventional hanger.
Figure 14:
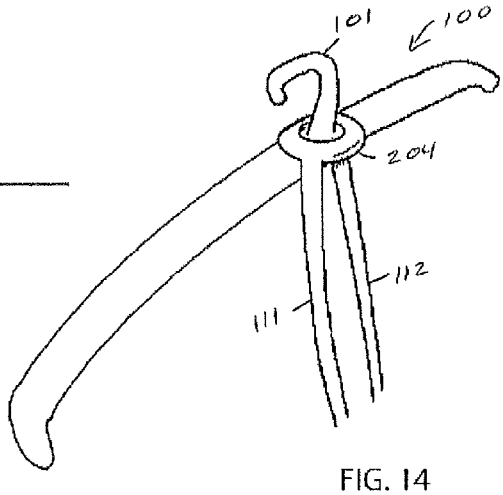
FIG. 14 shows the attachment in FIG. 10 with an alternative method of draping it over a conventional hanger.

As shown in FIG. 12 illustrating a side view of the attachment in FIG. 10, and FIG. 13 illustrating the top view of the attachment in FIG. 10, the bend 201 can be angled backward from the plane of the rest of the attachment 20 so as to more easily drape around the hook of a conventional hanger. Angling the bend 201 back in this way may also allow the bend 201 to rest against the back of the upward hook of a conventional hanger as the remainder of the attachment 20 hangs downward over the front of a conventional hanger, as shown in FIG. 10. It should be noted that other methods of attaching attachment 20 to a conventional hanger can be used. For example, the bend 201 can instead be a plate 204 that completely encircles upward hook 101 and rests on bar element 100. (See FIG. 14.)

Figure 15:
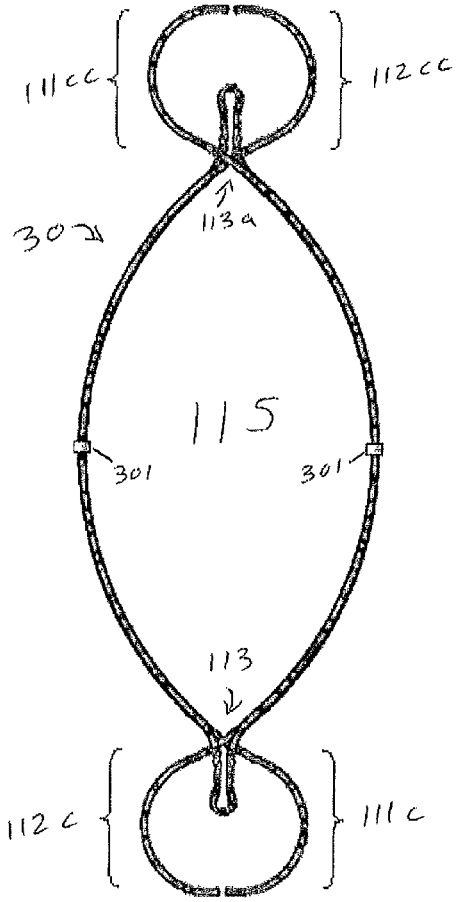
FIG. 15 is an illustration of an embodiment in which the attachment of FIG. 10 is doubled up and flipped to create a new attachment.
Figure 15A:
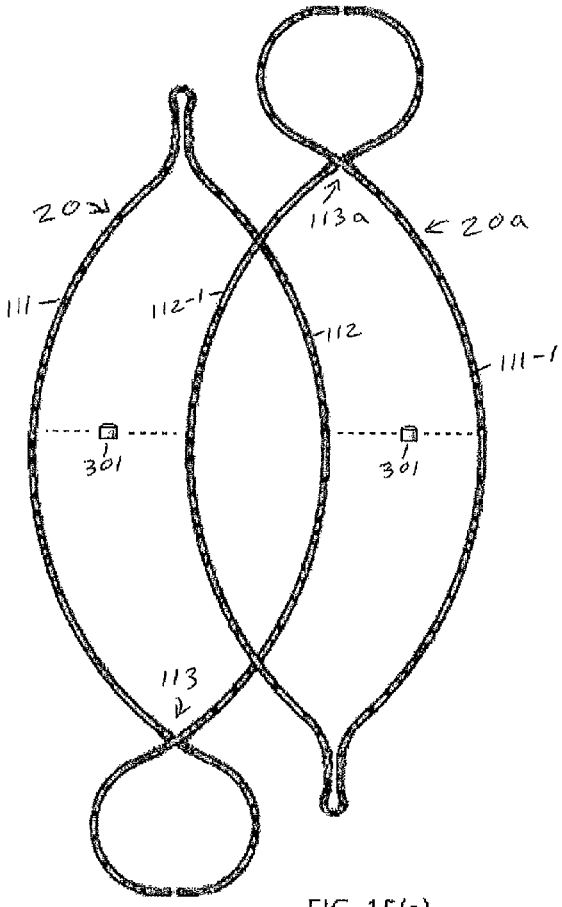
Figure 15B:
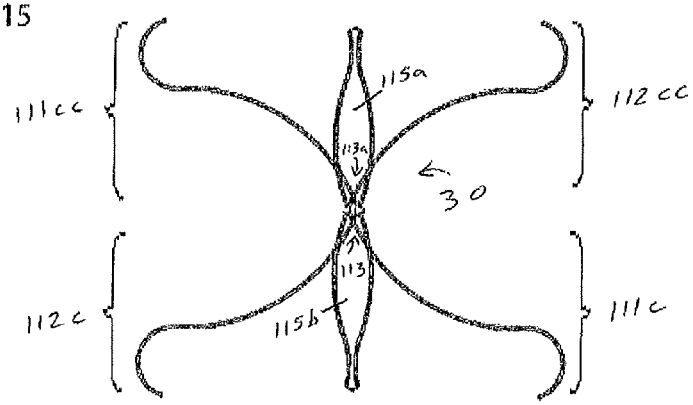

FIG. 15 illustrates an attachment assembly 30 to a conventional clothes hanger that thereby forms an expandable clothes hanger and provides a mechanism for expanding laterally both the top and bottom portions of the hanger in order to pull taut both the top and bottom area of a draped garment. (FIG. 15(*a*) shows an exploded version of FIG. 15.) The attachment assembly 30 consists of a first attachment 20, and a second attachment 20*a* that is identical to the first attachment 20 but flipped 180 degrees along the latitudinal center with respect to the first attachment 20, so that the second attachment 20*a* is placed upside-down on top of the first attachment 20, and the ellipse 115 of both hangers are substantially aligned with one another and largely match in area and placement. Thus, the distal portion 111*cc*, 112*cc* of downward elements 111-1, 112-1 of attachment 20*a* extend beyond the opposite end of ellipse 115 from intersection 113 of attachment 20; and the distal portion 111*c*, 112*c* of downward elements 111, 112 of attachment 20 extend beyond the opposite end of ellipse 115 from intersection 113*a* of attachment 20*a*.

It is further noted that each of the first and second attachments 20, 20*a* are identical to the attachment 20 shown and described with respect to FIGS. 10-14. Thus, the head 201 of either of the attachments 20, 20*a* can be positioned about a conventional hanger as in FIGS. 10-11. Rings 120 can be used at intersection points 113, 113*a*, if desired.

A small clasp, adhesive, or other binding 301 is provided to hold the attachments 20 and 20*a* together at the longitudinal center of each side of ellipse 115. Each of the bindings 301 must be strong enough to hold the attachments 20 and 20*a* together, but small enough to allow the attachments 20 and 20*a* to pivot relatively freely on either side of the binding 301. The binding 301 should remain firmly in place, so as not to slide along downward elements 111, 112, 111-1, 112-1, by the gripping pressure, friction, adhesive quality, or by other means. For example, the binding 301 in FIG. 15 is circular with a central opening that receives downward elements 111, 112, 111-1, 112-1, and encircles the downward elements tightly enough as to not move from that position. The binding 301 can be made of metal, plastic, rubber, or other suitable material.

Bringing together the two sides of the longitudinal center of the ellipse 115 causes intersection points 113, 113*a* to come toward each other, which creates two ellipses—115*a* for attachment 20 and 115*b* for attachment 20*a*—that overlap slightly at intersection points 113, 113*a*. Bringing together the two sides of the longitudinal center of the ellipse 115 also causes the distal portion 111*c*, 112*c* of the downward elements 111, 112 of attachment 20 to expand away from each other, and causes the distal portion 111*cc*, 112*cc* of the downward elements 111-1, 112-1 of the attachment 20*a* to expand away from each other. (See FIG. 15(*b*).) This outward movement of the distal portions pulls taut both the upper and lower portion of the article of clothing. The weight and tension provided by the upper portion of some articles of clothing (e.g., the shoulder portion of a shirt) may cause distal portion 111*cc*, 112*cc* of downward elements 111-1, 112-1 of the attachment 20*a* to lower slightly. Thus, distal portion 111*cc*, 112*cc* should conform to the shape of the article of clothing while providing adequate support.

Figure 16:
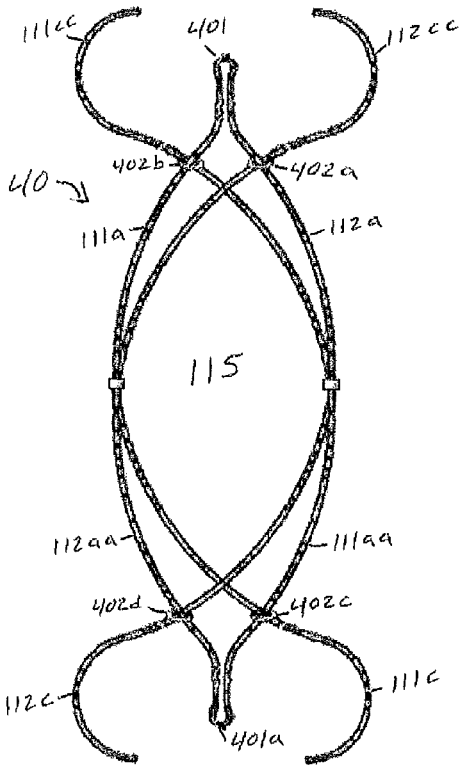
FIG. 16 is an illustration of another embodiment of the attachment of FIG. 10.

As shown in FIG. 16, in order to provide additional stability to the attachment assembly 30, moveable rings 402 are provided to bind together the attachments 20 and 20*a* in strategic places to form an attachment assembly 40. The rings 402 should be able to slide freely along the downward elements of the attachments 20 and 20*a*. For example, ring 402*a* can bind 112*a* to 112*cc*, ring 402*b* can bind 111*a* to 111*cc*, ring 402*c* can bind 111*c* to 111*aa*, and ring 402*d* can bind 112*c* to 112*aa*. Expanding the attachment assembly 40 by contracting the ellipse 115 causes these rings to slide toward each other along the downward elements 111, 112 and the downward elements 111-1, 112-1. (See FIG. 16(*a*).) Of course, these ring placements are just examples; there may be more or fewer rings utilized and the rings can be located in different places. Further, use of the rings may make bindings 301 unnecessary.

Figure 17:
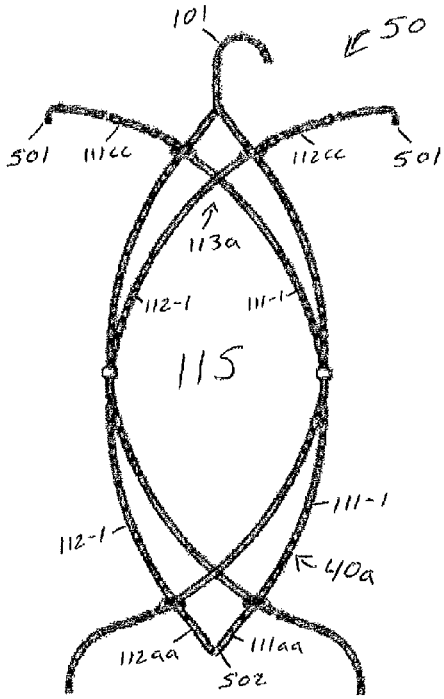
FIG. 17 is an illustration of a hanger form of the attachment of FIG. 10.
Figure 16A:
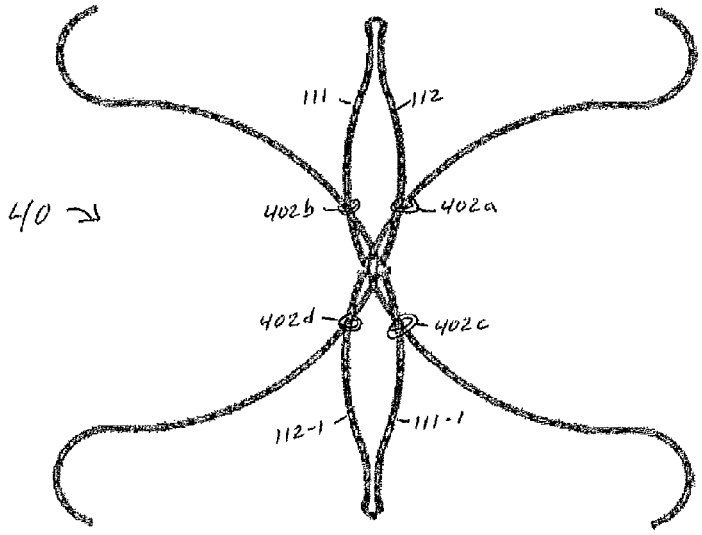

In a further embodiment shown in FIG. 17, the hanger 50 is formed by making additional adjustments to the attachment assembly 40. These adjustments can include, but are not limited to the following. The distal portion 111*cc*, 112*cc* of the downward elements 111-1, 112-1 are angled slightly up and laterally away from the intersection 113*a* (rather than the half-circular curve in FIG. 16) so as to better support the shoulder portion of a draped article of clothing (and ideally ensuring that tips 501 of distal portion 111*cc*, 112*cc* are curved or otherwise blunted so as not to damage the material of the draped article of clothing). Placing a hook 101 where the bend 401 would be, so that the distal portion 111*cc*, 112*cc* would replace the need for bar element 100 of a conventional hanger. Accordingly, the hook 101 attaches to a clothing bar and the hanger 50 does not need to attach to a conventional hanger. Removing the area on the attachment 40*a* where the bend 401*a* would be, so that the upper portions 111*aa*, 112*aa* come together to meet (502) without then continuing on to bend 401*a* (which is no longer needed since it is at the other end of hook 101). These are just three examples of element alterations that may be made to form the hanger 50.

Figure 18:
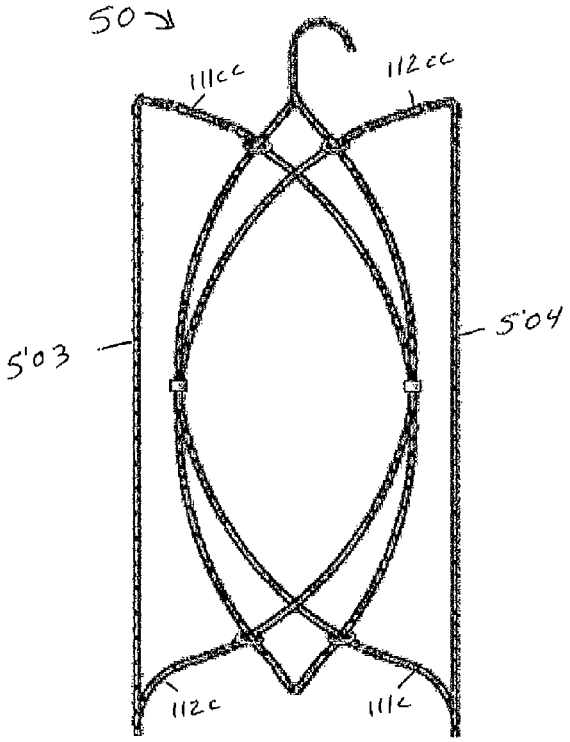
FIG. 18 is an illustration of another embodiment of the hanger of FIG. 17.

As shown in FIG. 18, in a further embodiment of the hanger 50, a connecting element 503 is provided from the extreme tip of the distal portion 111*cc* vertically to the extreme tip of the distal portion 112*c*, and a connecting element 504 is provided from the extreme tip of the distal portion 112 cc vertically to the extreme tip of the distal portion 111*c*. The connecting elements 503, 504 are connected to the distal portions as a single piece, or can be attached by adhesive, interlocking pieces, or any other means. The connecting elements 503, 504 are preferably formed of metal wire, plastic, rubber or other suitable material, but should be strong enough to support the sides of the draped article of clothing after the hanger 50 is expanded to pull taut the draped article of clothing. Further, they should be strong enough to hold the extreme tips of the distal ends the same distance from each other regardless of the position (i.e., set, rest, or otherwise) of the hanger. (Alternatively, connecting elements 503, 504 can be cut at the middle so as to make two separate pieces that slide together/apart from one another as the hanger expands/contracts and thus moves the distance between the extreme tips of the distal portions.) Thus, once the hanger 50 is expanded, lateral support for a draped article of clothing is provided from the top shoulder area by the distal portion 111*cc*, 112*cc*, along the sides by connecting element 503, 504, to the bottom by distal portion 111*c*, 112*c*. (See FIG. 19.)

Figure 19:
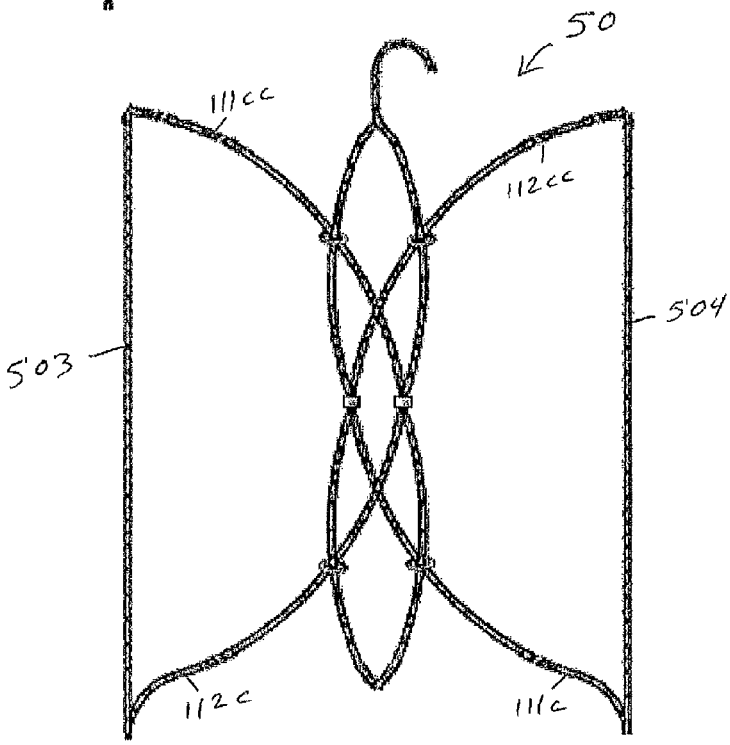
FIG. 19 shows the hanger of FIG. 18 in an expanded position.

As shown in FIGS. 1-14, the expandable clothes hanger (except for the moveable rings) is a one-piece structure, though pieces may be attached to each other to form a one-piece structure, or may work together as if in a one-piece structure. As shown in FIGS. 15-17, the expandable clothes hanger (except for bindings and moveable rings) is a two-piece structure, though pieces may be attached to each other to form a two-piece structure, or may work together as if in a two-piece structure. As shown in FIGS. 18-19, the expandable clothes hanger (except for bindings, moveable rings, and connecting element 503, 504 if separate) is a two-piece structure, though pieces may be attached to each other to form a two-piece structure, or may work together as if in a two-piece structure.

In all of the figures, the elements are preferably thin elongated rods with a circular cross section that are formed of metal wire, plastic, rubber or other suitable material. However, any suitable size and shape can be utilized. The expandable clothes hanger can be supplemented with padding or other cover material to further fill out the draped article of clothing.

The foregoing disclosure of the preferred embodiments of the present invention has been presented for purposes of illustration and description. It is not intended to be exhaustive or to limit the invention to the precise forms disclosed. Many variations and modifications of the embodiments described herein will be apparent to one of ordinary skill in the art in light of the above disclosure. For instance, while two downward elements 111, 112 are shown, it is apparent that only a single downward element can be provided which extends outward in either one direction or in two opposing directions. In addition, while the invention has been described for use as or with a hanger, it can be used for other purposes and/or with other devices. For example, the configurations shown in FIGS. 15, 16 could be used as a double-sided clasp that opens at the distal ends 111*c*, 112*c*, and at 111*cc*, 112*cc* simultaneously when ellipse 115 is compressed, and closes when ellipse 115 is expanded. The configuration shown in FIG. 18 could be used to expand or push apart objects (or raise objects if the configuration is turned 90 degrees) by compressing the ellipse to push apart elements 503, 504. The configuration shown in FIG. 18 could also be used like a compound bow, where pulling apart elements 503, 504 compresses the ellipse and creates inward tension between elements 503, 504 that is forcefully released when one of the elements 503, 504 is released. The scope of the invention is to be defined only by the claims appended hereto, and by their equivalents.

Further, in describing representative embodiments of the present invention, the specification may have presented the method and/or process of the present invention as a particular sequence of steps. However, to the extent that the method or process does not rely on the particular order of steps set forth herein, the method or process should not be limited to the particular sequence of steps described. As one of ordinary skill in the art would appreciate, other sequences of steps may be possible. Therefore, the particular order of the steps set forth in the specification should not be construed as limitations on the claims. In addition, the claims directed to the method and/or process of the present invention should not be limited to the performance of their steps in the order written, and one skilled in the art can readily appreciate that the sequences may be varied and still remain within the spirit and scope of the present invention.

What is claimed is:

1. An expandable clothes hanger device, comprising:

a bar element upon which an article of clothing can be draped;

a hook extending upward from the bar element; and two downward extending elements, extending downward from the bar element and crossing one another at an intersection to substantially form an ellipse, said two downward extending elements each having a distal end portion past the intersection, wherein said bar, downward extending elements, and distal end portions are substantially in a vertical plane;

wherein said two downward extending elements are configured to be placed in a first closed position to expand the ellipse and bring together the distal end portions, and a second open position to contract the ellipse and move apart the distal end portions in directions substantially in the vertical plane to make taut a lower portion of the article of clothing.

2. The expandable clothes hanger device of claim 1, wherein the distal end portions have reverse bends and distal ends that come together past the intersection in the first position.

3. The expandable clothes hanger device of claim 1, wherein the expandable clothes hanger is formed of a single piece of material with a separate moveable ring at the intersection.

4. The expandable clothes hanger device of claim 1, wherein said device comprises an attachment that can be attached to a conventional clothes hanger.

5. The expandable clothes hanger device of claim 1, further comprising a second set of downward extending elements that can be used to protect an upper portion of the draped article of clothing.

6. The expandable clothes hanger device of claim 1, wherein said two downward extending elements move outward in side-to-side directions.

7. An expandable clothes hanger device comprising:

a first element curved to form an open first ellipse and extending in opposite directions past a first intersection at which the first element crosses over itself, said first element having two distal ends past the first intersection; and a second element curved to form an open second ellipse and extending in opposite directions past a second intersection at which the second element crosses over itself, said second element having two distal ends past the second intersection, wherein said second element is inverted with respect to the first element whereby the first ellipse is substantially aligned with the second ellipse, and the first intersection is at a top position and the second intersection is at a bottom position spaced apart from the top position;

wherein said first and second elements are in a vertical plane;

wherein the first and second elements have a first position in which the distal ends of said first and second elements are retracted and the first and second ellipses are expanded, and second position in which the distal ends of said first and second elements are in an expanded position and the first and second ellipses are compressed, wherein the first and second elements move in directions in the vertical plane between the first and second positions.

8. The expandable clothes hanger device of claim 7, wherein the extending ends of each of the elements are biased inward toward each other.

9. The expandable clothes hanger device of claim 7, wherein the extending ends of each of the elements are biased away from each other.

10. The expandable clothes hanger device of claim 7, wherein the crossing points each hold a ring which receives the extending ends of the elements.

11. The expandable clothes hanger device of claim 7, wherein the elements are further held together by rings that moveably slide along the elements.

12. The expandable clothes hanger device of claim 7, wherein a support curve or platform is configured on one of the elements to form a hook or be coupled with a clothes hanger.

13. The expandable clothes hanger device of claim 7, wherein ends of the elements are connected to each other on either side of the hanger device.

14. The expandable clothes hanger device of claim 7, wherein operation is controlled without having to reach through or under an article of clothing.

15. The expandable clothes hanger device of claim 7, wherein said device can be used for purposes other than hanging clothes.

16. The expandable clothes hanger device of claim 7, wherein one end of the open ellipses further comprises a hook extending upward.

17. The expandable clothes hanger device of claim 7, wherein said hanger device comprises an attachment that can be attached to a conventional clothes hanger.

* * * * *